US008523651B2

(12) United States Patent
Ditton et al.

(10) Patent No.: US 8,523,651 B2
(45) Date of Patent: Sep. 3, 2013

(54) APPARATUS AND METHOD FOR PLAYING A GAME

(75) Inventors: Richard A. Ditton, Kildeer, IL (US); Elaine A. Hodgson, Kildeer, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 0 days.

(21) Appl. No.: 13/413,263

(22) Filed: Mar. 6, 2012

(65) Prior Publication Data

US 2012/0238339 A1 Sep. 20, 2012

Related U.S. Application Data

(60) Provisional application No. 61/454,088, filed on Mar. 18, 2011.

(51) Int. Cl.
*A63F 9/24* (2006.01)

(52) U.S. Cl.
USPC ..... 463/16; 463/13; 463/20; 463/25

(58) Field of Classification Search
USPC ..... 463/1, 11, 13, 16, 25, 31, 41–42
See application file for complete search history.

(56) References Cited

U.S. PATENT DOCUMENTS

| | | | | |
|---|---|---|---|---|
| 6,604,998 | B1 * | 8/2003 | Singer et al. | 463/13 |
| 2007/0155465 | A1 * | 7/2007 | Walker et al. | 463/16 |
| 2008/0085769 | A1 * | 4/2008 | Lutnick et al. | 463/41 |
| 2008/0254881 | A1 * | 10/2008 | Lutnick et al. | 463/31 |
| 2009/0061999 | A1 | 3/2009 | Popovich et al. | |
| 2010/0124959 | A1 * | 5/2010 | Demsetz et al. | 463/1 |
| 2010/0167802 | A1 * | 7/2010 | Walker et al. | 463/11 |
| 2010/0203953 | A1 | 8/2010 | Alderucci et al. | |

OTHER PUBLICATIONS

PCT International Search Report, dated Jun. 8, 2012, corresponding to International Application No. PCT/US12/28030.
PCT Written Opinion of the International Searching Authority, dated Jun. 8, 2012, corresponding to International Application No. PCT/US12/28030.

* cited by examiner

*Primary Examiner* — Dmitry Suhol
*Assistant Examiner* — Jason Yen
(74) *Attorney, Agent, or Firm* — Husch Blackwell LLP

(57) ABSTRACT

A gaming system and method that analyzes and evaluates a player's play input in accordance with a statistically optimal play and generates an acknowledgement where the play input is consistent with an optimum play in response to a particular game condition. The gaming system features at least one display device, at least one player input device, at least one programmable processor coupled to the display device and at least one storage unit coupled to the processor. The storage unit stores a plurality of instructions executable by the programmable processor for performing the method.

17 Claims, 9 Drawing Sheets

APPARATUS AND METHOD FOR PLAYING A GAME

CROSS REFERENCE TO RELATED APPLICATION

This application claims the benefit of U.S. Provisional Patent Application Ser. No. 61/454,088 filed Mar. 18, 2011, the entirety of which is incorporated herein by reference.

FIELD

The invention pertains to a system and method for playing a game. More particularly, the invention pertains to a system and method that analyzes and evaluates a player's play input in accordance with a statistically optimal play and generates an acknowledgement where the play input is consistent with an optimum play.

BACKGROUND

It is generally known that games can be "solved" either through deductive analysis of through empirical analysis. In the case of the latter, this is typically known as going through the "game cycle" of the game—beginning with all initial conditions or with some given intermediate condition, the statistically most advantageous move can be determined by reviewing the consequences of all possible moves. Selecting and performing the single most statistically advantageous move in such a game is known as "perfect play." Although perfect play does not always ensure the optimum outcome under all circumstances, especially when playing a game which contains random elements and/or suboptimum opponents, it will typically give a player the highest chance of obtaining an optimum game outcome in a particular condition according to the game rules. Perfect play analysis has usually been used to create more challenging mechanical opponents for human beings. In addition, evaluating whether a human player has performed the perfect play is a known training technique.

Gaming machines featuring games whereby a player is given the opportunity to select a play choice in response to a particular game condition are generally known and very popular. As such games involve an element of strategy as well as randomness, a particular play choice may or may not always be determinative of the outcome of the game. Thus, a player playing the game does not always know when they have made the best play choice in response to a particular game condition based on the outcome. It would thus be desirable to provide a system and method that evaluates the player's play choice in a particular game condition in accordance with a statistically optimal play, and further generate an acknowledgement where the play input is consistent with an optimum play under the particular game condition. It is believed that such an acknowledgement would heighten a player's enjoyment of the game and induce the player to continue playing the game or select the game over other competing games in the future.

It would further be desirable to provide a system and method for tracking and displaying a given number of perfect plays so that the player or operator has additional information about the particular level of skill for a given player, at a particular location, or in response to a particular game condition. It is believed that operators of such gaming machines could further utilize this information to provide additional prizes or rewards in addition to the scoring/reward system inherent to the individual game.

It would further be desirable to provide a system and method that tracks and displays how fast a player or group of players play the game or multiple additional games. As players having greater skill with respect to a particular game can generally play the game at a faster pace, information regarding the time of a particular game or number of games played in a particular time, will generally be useful to accessing the relative skill of a player or group of players. In addition, the operator of such a game could use this additional information to provide additional prizes or rewards in addition to the scoring/reward system inherent to the individual game.

It is further believed that it would be desirable to provide a system and method that tracks and evaluates both perfect play and rapid play. Such a system and method would be beneficial to awarding additional prizes or rewards, or for hosting or managing a tournament of competing players of the same or different games.

In addition, it is further believed that it would be desirable to provide a system and method that can adjust the odds of the game or the amount of payout/reward in response to information collected regarding the number of perfect plays or how fast a player or group of players plays the game.

As set forth herein, embodiments of the subject invention are directed to satisfying each of these needs.

DETAILED DESCRIPTION

Figure 1:
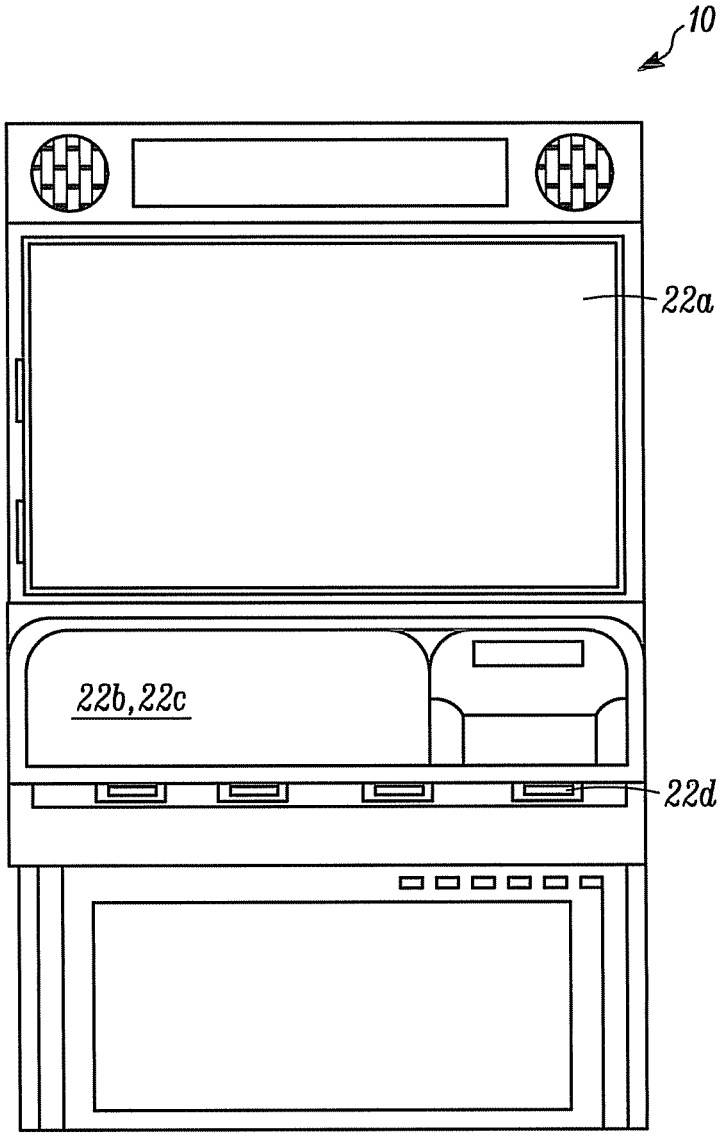
FIG. 1 is a front elevational view of a gaming apparatus in accordance with embodiments of the subject invention.
Figure 1A:
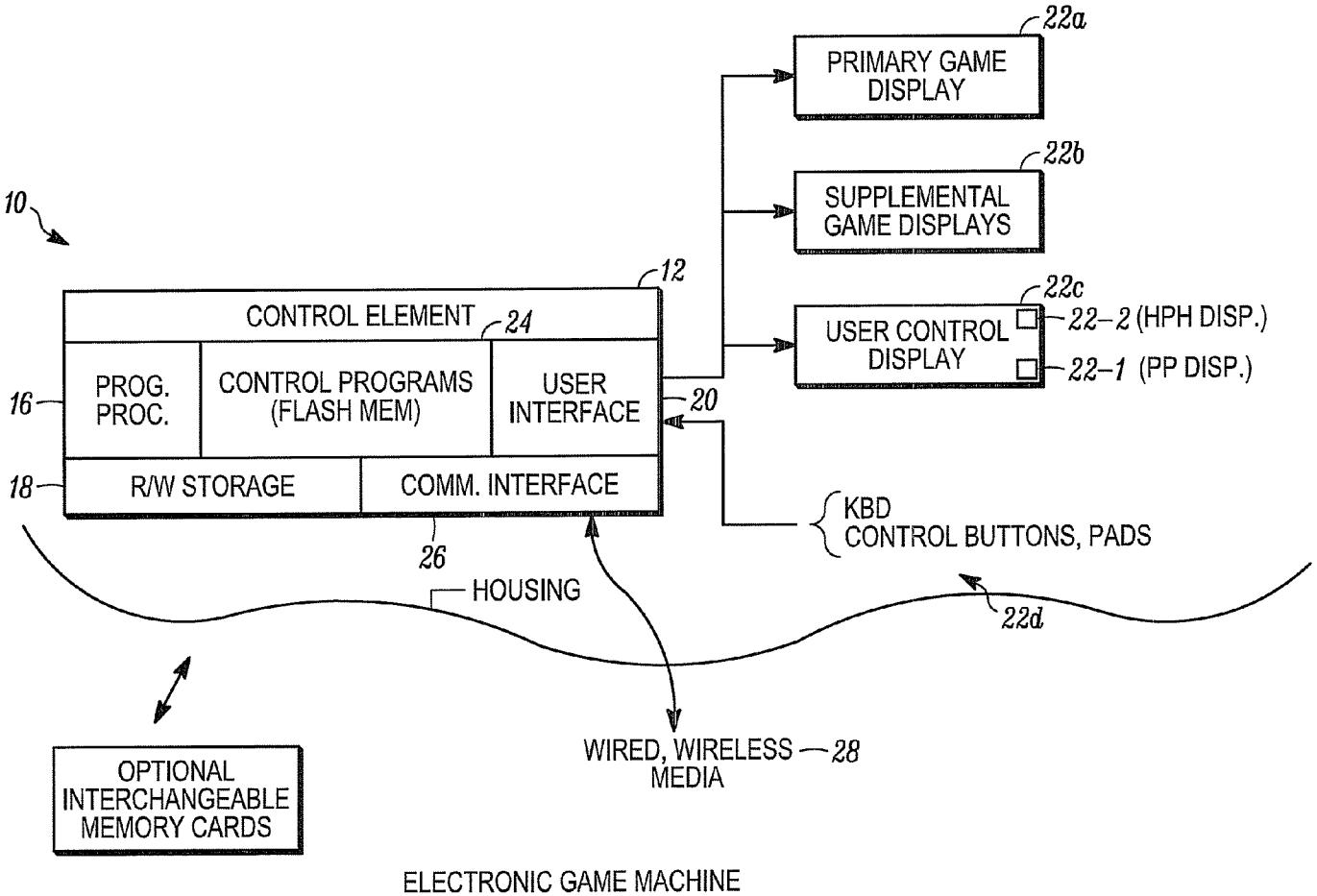
FIG. 1A is a representational view of a gaming apparatus as in FIG. 1 and in accordance with embodiments of the subject invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated. Specifically, although embodiments of the subject invention are set forth herein for use in connection with a video poker game, the subject embodiments are not limited to such and can be applied for use in connection with any game with a perfect play structure, without limitation.

Figure 2:
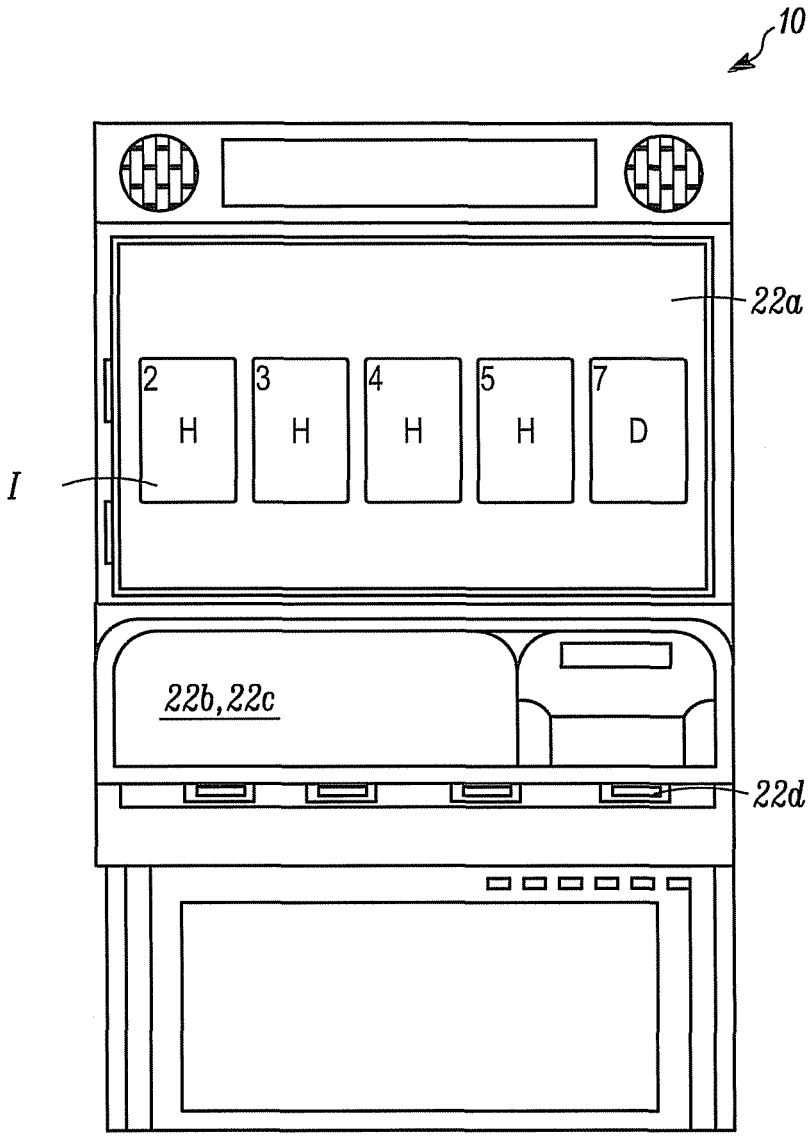
FIG. 2 is a representational front elevational view of the apparatus shown in FIG. 1 or 2 with a poker hand displayed thereon.
Figure 3:
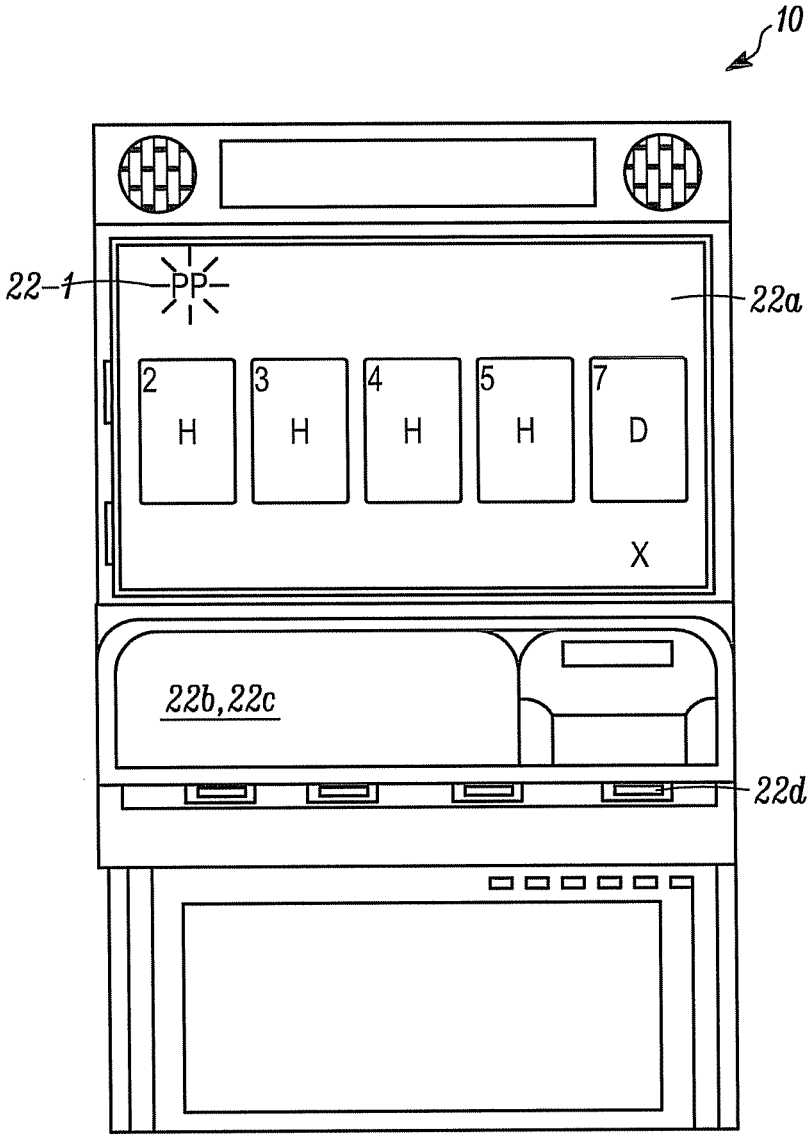
FIG. 3 is a representational front elevational view of the apparatus shown in FIGS. 1 and 2 with a perfect play indicator.

With reference now to the figures, and specifically, FIGS. 1-3, there is shown a gaming apparatus 10 featuring at least one display device 22*a* 22*b* 22*c* such as for example, a flat panel LCD or LED display device, at least one input device 22*d* and a user interface 20. The apparatus further can have at least one programmable processor 16 coupled to the display device 22*a* 22*b* 22*c* and user interface 20, and at least one storage unit 18 coupled to the processor 16. According to embodiments of the subject invention, the storage unit 18 can store a plurality of instructions executable by the programmable processor 16 to present on the display device 22*a* 22*b* 22*c* a plurality of play choices. The instructions can further be configured to receive a play choice from a player from input devices 22*d* and user interface 20 and evaluate the choice relative to a pre-established optimum outcome which is in accordance with a selected criterion and generate at least one visual indicator of a match between the choice and the optimum outcome.

According to embodiments of the subject invention, at least one display device, 22*a* 22*b* 22*c*, can be a visual output device configured to provide a visual indicator of the match or game being played. In one embodiment, shown in FIG. 2, the gaming apparatus can be a video poker machine 10 and the game display 22*a* can be configured to display a plurality of playing card images "I". According to such embodiments, a play choice could be either discarding at least one card image, or selecting at least one card image to be retained via user control elements 22*d*.

In the embodiment shown in FIGS. 2 and 3, The player has been dealt 2H-3H-4H5H-7D (wherein "H" is Hearts and "D" is diamonds, common card suits). Under the laws of poker, it the player discards the 7D and can draw another H card, the player will have a flush; alternatively, if the player can draw an ace or a 6, they will have a straight. Instead, if the player discards any H card they diminish their chance for obtaining a flush and can get nothing better than a pair if they discard cards that will lower the potential for a straight. Thus, the Perfect Play under the illustrated game condition would be for the player to discard the 7D. In FIG. 3, the "X" signifies a visual indication that the player has chosen to discard only the 7D (this could be accomplished via a touchscreen as is presently known in connection with modern video poker machines by touching the cards that the player wants to keep or discard, or by pressing a button that corresponds to the particular cards that the player wants to discard/keep). As shown in FIG. 3, the display can include a Perfect Play 'PP' visual indicator 22-1 which is activated to advise the player that their selected play choice was in fact a Perfect Play under the particular game condition. Accordingly, whatever positive consequences are associated with a Perfect Play would now attach.

Figure 6:
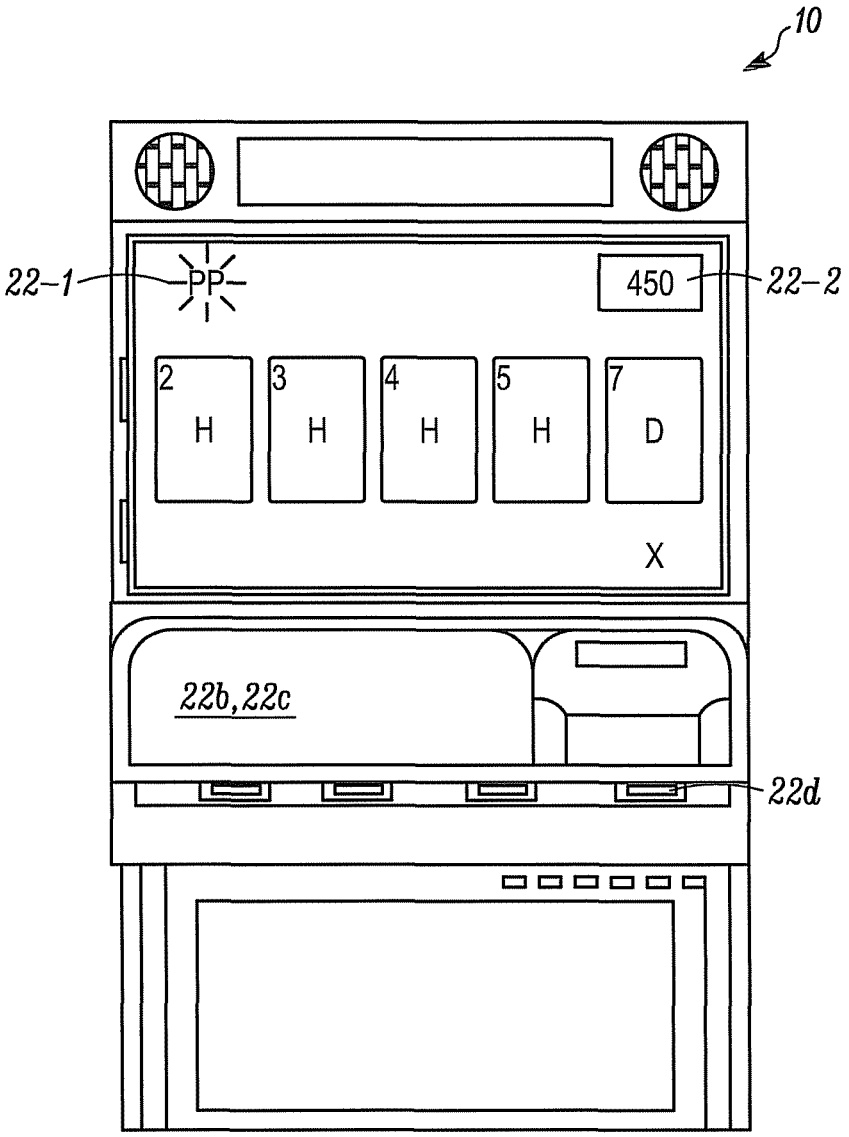
FIG. 6 is a representational view of an apparatus with both a perfect play indicator as shown in FIG. 3 and a hands-per-hour display as shown in FIG. 5.

According to such embodiments, a Perfect Play determination can be used to reward a player by either simply displaying a Perfect Play acknowledgement, or alternatively or cooperatively by some other incentive. If the player's play choice is in fact determined to be a Perfect Play, the visual indicator 22-1 can light up on the game display 22*a* as shown in FIGS. 3 and 6. Furthermore, the player may receive either a redeemable or nonredeemable credit of some kind, either directly increasing their winnings or allowing them to participate in some additional bonus or receive some additional incentive when the player completes a Perfect Play a predetermined number of times. The game can additionally be configured to reward a player for a streak of consecutive Perfect Plays, either through simple acknowledgement and approval, or again through some redeemable or nonredeemable incentive.

Figure 4:
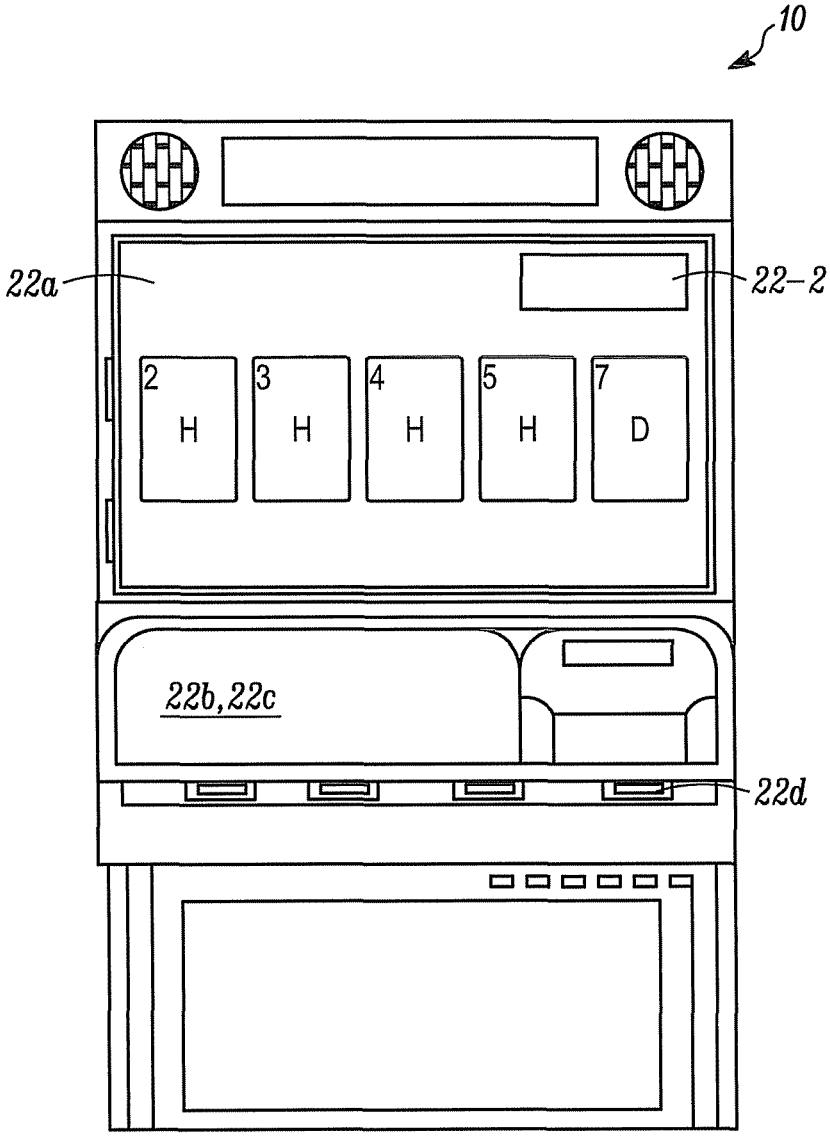
FIG. 4 is a representational front elevational view of the apparatus shown in FIGS. 1 and 2 with a hands-per-hour display.
Figure 5:
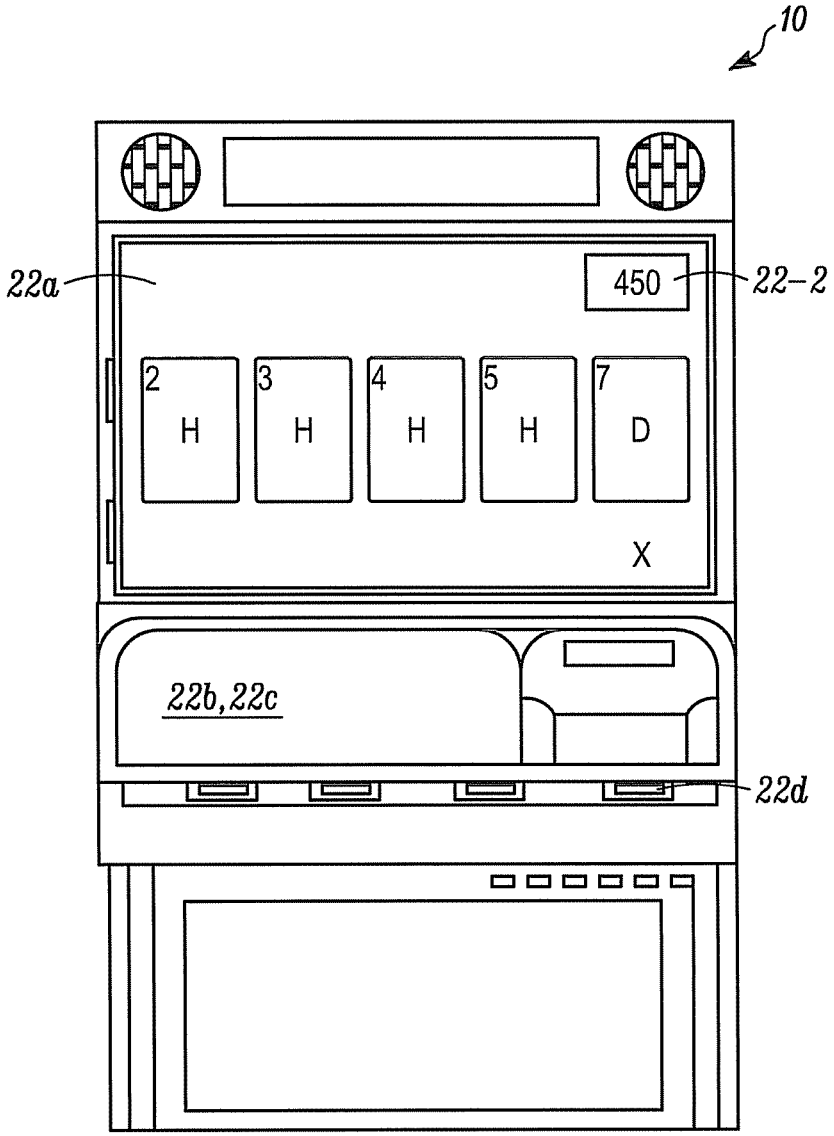
FIG. 5 is a representational front elevational view of the apparatus shown in FIG. 4 with an established hands-per-hour rate being displayed.

The gaming apparatus 10 can further establish a multi-game time interval and generate an indicum indicative of the number of plays per the established time interval. Embodiments can further provide a threshold number of plays for a predetermined time interval and compare the indicum of the plays per time interval to the threshold number. As show in FIGS. 4-6, the indicum can be an ongoing visual indicator 22-2 presented for example on display device 22*a*. Alternatively, the indicum can be displayed elsewhere or be non-visual signal or indication, without departing from the novel scope of the subject invention. The display of the indicum of the number of plays per established time can be dynamic, in that it applies to all play from the beginning of a session, or static, in that it applies to a fixed number of games. In the machine shown in FIGS. 4-6, the player's current average hands per hour has been calculated and displayed in a Hands-Per-Hour ("HPH") field 22-2 (see FIG. 5—where current HPH is displayed as "450"). Depending on the desired play style of a player, the machine operator can set the machine to calculate the HPH rate in many different ways. For instance, the preferred method would be to only count time between the display of the initial hand and the time that the player finalizes the hand. This can allow a player to pause the game to do other things between the actual plays (such as for example, get a drink, add money to the machine, etc.) without hurting their HPH rate. It would be preferred, in such a case, to have some time-out period after which the player's session is ended or the came can assess a penalty to the player. This process could prevent players from wasting too much time away from game play thereby reducing the machine's earnings and/or keeping other players waiting.

In addition, the game apparatus 10 can further track, individually and/or through a network of machines, a given number of Perfect Plays and/or plays per time interval in order to pay some progressive prize. For example, once a million Perfect Plays have occurred on a given set of machines, the next player who hits a hundred Perfect Plays in a row may win a monetary prize. Random sub-elements can also be incorporated into a progressive prize structure, such as for example a minimum and maximum number of Perfect Plays required to trigger a prize, but within which range the prize will be randomly awarded to some player, with a further triggering condition (e.g. 100 Perfect Plays in a row) required before the player is eligible to have a random chance to win the progressive prize. An additional incentive which can be provided by tracking Perfect Plays, could be to increase the player's odds of winning as a reward for sufficient perfect play. For instance, if a player gets fifty Perfect Plays in a row, the machine might switch from a standard paytable to a more advantageous paytable as would be known to those of skill in the art, for example an 8/5 paytable to a 9/6 paytable. A player can also be rewarded, according to various embodiments, for exceeding some HPH threshold, with some redeemable or unredeemable award (e.g. a simple "fast player" reward graphic, or additional credit which may be used to play more games and/or redeemed for cash). Further, the game can also alter the player's paytable based on their rate of play.

Figure 1B:
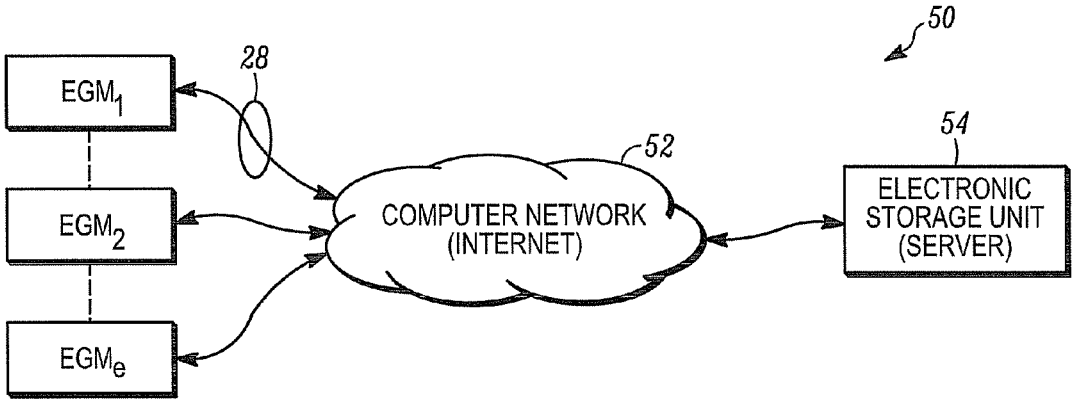
FIG. 1B is a representational view of a networked gaming system in accordance with embodiments of the subject invention.

FIG. 1B shows an additional embodiment whereby a networked gaming system 50 is provided. A plurality of games $EGM_1 \ldots EGM_e$ could be coupled via a network 52 to a common control server 54. According to this embodiment, game information can be communicated to players via the computer network 52, such as for example a local or wide area network, or wired or wireless network such as the internet, for example. Specifically, game information, including for instance information regarding Perfect Plays and play rate can be transmitted from/to one or more gaming machines $EGM_1$ . . . $EGM_e$ to/from a central server 54 and/or other remote storage device, database, display and/or printer.

Embodiments of the subject invention further provide for the combination of determining and presenting both Perfect Play and play rate. A machine, such as a game machine 10, presenting both Perfect Play and play rate indicia 22-1, 22-2 is shown in FIG. 6. In addition to presenting this information to a player, the game can combine these two factors for purposes of calculating a predetermined combination score which meets or exceeds a target score and results in a reward (or detriment) to the player. Such a processing could be simply the rate of play score multiplied by the absolute ratio of Perfect Plays to total plays expressed as a fraction, or could be some more complex calculation designed to give more or less weight to the ratio of Perfect Plays verses rate of play. One example of an alternate process could be to use a rapid play evaluation system, but impose some penalty on the player (e.g. adding two seconds to the actual time expanded on the hand) for any hand that is not played perfectly. Alternatively, either of the individual systems could be used, but the other could be used to resolve ties, when applied to games in which ties are possible and occur with enough frequency to require an interesting method of resolving.

Figure 1C:
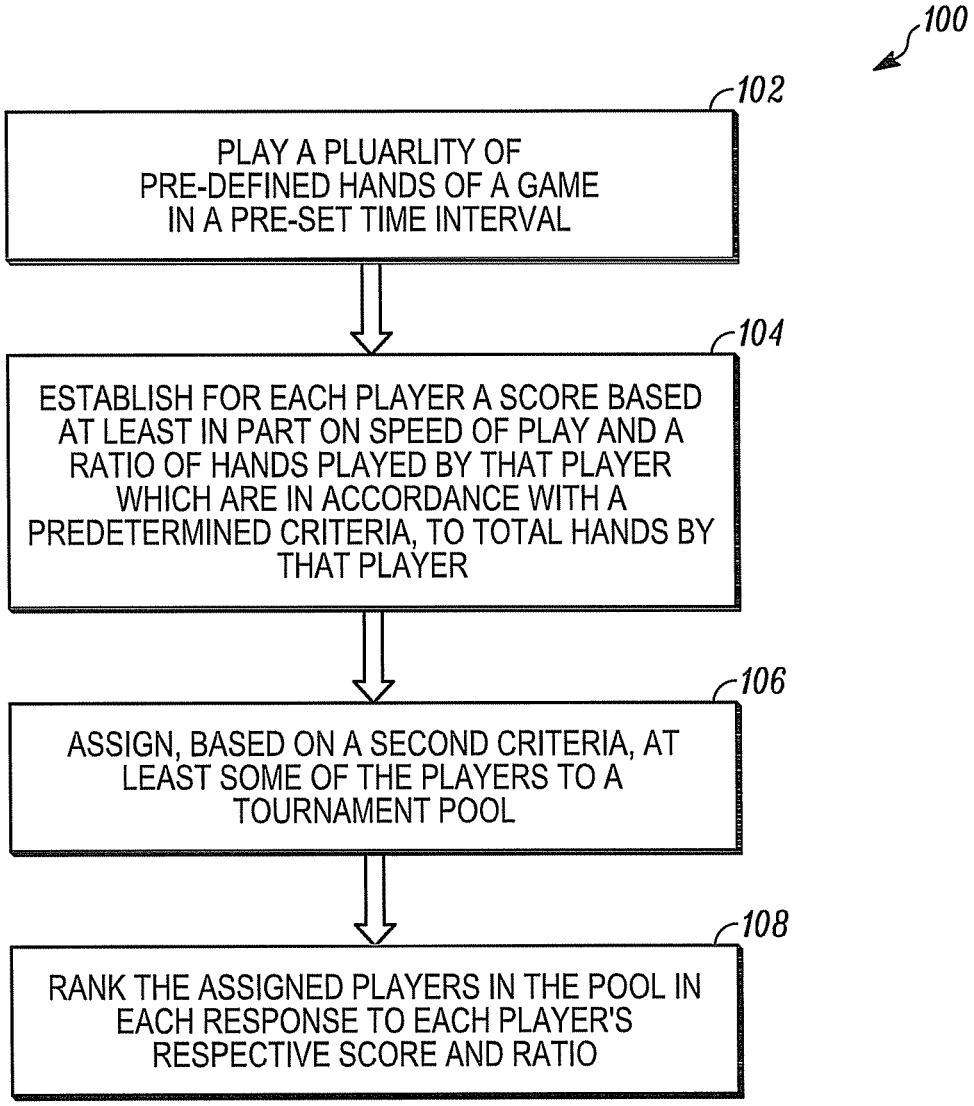
FIG. 1C is a flowchart showing a method in accordance with embodiments of the subject invention.

Additional embodiments of the subject invention provide for conducting a tournament based on an evaluation of Perfect Play and/or Play Rate from multiple individual games as in FIG. 1B. FIG. 1C illustrates a flowchart of one method 100 in which such tournament can be conducted. According to the illustrated embodiment, a plurality of hands of a game are played in a pre-set interval, as at 102, by a plurality of players at different game machines. Utilizing a predetermined method, a player's score based on the speed of play (e.g. number of poker hands played) combined with their ration of plays to Perfect Plays can be determined as at 104. According to such embodiments, a player can be assigned, either at random or according to any desired (and lawful) ranking system (e.g. geographic, size of tournament prize, size of pool desired, time length, predetermined skill level or handicap) to a pool of players competing in a tournament as at 106. When all players assigned to a pool have completed play, their scores can be ranked and prizes can be paid to the top ranked players according to a predetermined prize format as at 108. In addition, multiple prize formats can be applied either to separate tournaments (e.g. a pure rapid-play tournament or a pure Perfect Play tournament) or to additional prizes within a main tournament (e.g. the main prizes can be assigned by rank of total score, but the player that had the fastest play and/or the best Perfect Play ratio could win some additional prize/reward). Alternatively, a tournament based on either Perfect Play or play rate individually could be provided, but the other factor could be used to resolve ties, when applied to games in which ties are possible and/or occur with enough frequency to require an interesting method of resolving.

Such tournament play can be accomplished in either a dedicated amusement environment, where the actual outcome of the game is for pure entertainment purposes, or in an environment where the outcome of the game has some additional implication, such as for example a tournament between "live" gaming machines which pay on a paytable is usual and customary in the gaming industry as in system 50. Moreover, tournament play can be either a deliberate and primary feature, or a secondary feature wherein the players are primarily interested in the individual games but get participation in the tournament as an additional bonus feature (for which they may or may not pay a premium).

An additional feature in an embodiment in which players are also paying per game (such as a traditional gaming video poker machine) is that if a player runs out of per game credits, they could be allowed to continue playing for free in order to complete their tournament play. It would be preferred, however, that in such an instance, the player not receive the reward that they might otherwise receive for the outcome of the individual game. This could be automatic, or alternatively dependent on the number of plays remaining, amount wagered or some other parameter such as the player's player club status.

Embodiments of the subject invention further provide for a method for allowing players of a chance-based game(s) to participate in a tournament with skill-based game players. For instance, in the preferred embodiment, some players playing on a chance-based traditional video poker machine in a casino or other appropriate location, and being paid on a paytable as is usual and customary in the gaming industry for the outcome of individual hands, can be scored just like other players that are playing only for a skill-based score evaluation. Thus both such players can participate and compete against each other in a single tournament. In such embodiments, it could be possible for the scoring of the skilled portion to be done while still retaining the chance-based outcome and continuing the game to its logical conclusion. In addition, participation in the tournament could require an additional entry premium and/or be offered as an added incentive to play on a traditional gaming device.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A gaming system comprising:

at least one gaming machine having at least one display device;

at least one input device;

at least one programmable processor coupled to the display device and the input device; and at least one storage unit, coupled to the processor, wherein the unit stores a plurality of instructions executable by the programmable processor to, present on the display device a plurality of play choices;

receive from the input device a play choice from a player;

evaluate the choice relative to a pre-established optimum outcome which is in accordance with a selected criterion;

generate at least one visual indicator of a match between the choice and the optimum outcome, the visual indicator presented on the at least one gaming machine that received the play choice which generated the match with the optimum outcome during play of a game; and establish a threshold number of matches between the choice and the optimum outcome for a predetermined time interval and compare the threshold number to an actual number of matches between the choice and the optimum outcome that occur on the game system in a given time period corresponding to the predetermined time interval.

2. A system as in claim 1 which includes a visual output device, coupled to the processor, to provide the visual indictor of the match.

3. A system as in claim 1 where the game display comprises a plurality of playing card images.

4. A system as in claim 1 which includes providing a player award where the choice and the optimum outcome match.

5. A system as in claim 1 which, responsive to the comparing, establishes a player award.

6. A system as in claim 3 where the play choice comprises at least one of, discarding at least one card image, or selecting at least one card image to be retained.

7. A system as in claim 6 which includes a visual output device, coupled to the processor, to provide the visual indictor of the match.

8. A system as in claim 1 which includes establishing a multi-game time interval; and generating an indicium indicative of the number of plays per the established time interval.

9. A system as in claim 8 which includes generating a visual indicator of the number of plays per the established time interval.

10. A system as in claim 9 which includes a display device for visually presenting the visual indicator of the number of plays per the established time interval.

11. A system as in claim 10 which includes providing a threshold number of plays for a predetermined time interval and comparing the indicium of the plays per time interval to the threshold number.

12. A system as in claim 11 which, responsive to the comparing, establishes a player award.

13. A gaming system comprising:

at least one gaming machine having at least one display device;

at least one input device;

at least one programmable processor coupled to the display device and the input device; and at least one storage unit, coupled to the processor, wherein the unit stores a plurality of instructions executable by the programmable processor to, present on the display device a plurality of play choices;

receive from the input device a play choice from a player, establish a multi-game time interval;

generate a visual indicium on the at least one display device that is indicative of a number of plays per the established time interval, the indicium presented on the at least one gaming machine where each of the number of plays have been performed; and providing a threshold number of plays for a predetermined time interval and comparing the indicium of the plays per time interval to the threshold number.

14. A system as in claim 13 which, responsive to the comparing, establishes a player award.

15. A system as in claim 13 which includes evaluating the play choice relative to a pre-established optimum outcome which is in accordance with a selected criterion; and generating at least one visual indicator of a match between the choice and the optimum outcome.

16. A gaming machine comprising:

at least one display device for presenting a plurality of play choices;

at least one input device for accepting a play choice;

at least one programmable processor coupled to the display device and the input device; at least one storage unit coupled to the processor, the unit storing a plurality of instructions executable by the programmable processor, the instructions evaluating the play choice relative to a pre-established optimum outcome which is in accordance with a selected criterion establishing a threshold number of matches between the choice and the optimum outcome for a predetermined time interval and comparing the threshold number to an actual number of matches between the choice and the optimum outcome that occur on the game system in a given time period corresponding to the predetermined time interval; and a visual indicator presented on the at least one display, the indicator activating where during play of the game, the input device of the machine accepts a play choice that matches the optimum outcome.

17. The game machine of claim 16 wherein the display further comprises a visual indicium that presents a number of plays performed in an established time interval, the indicium presented on the display of the gaming machine where each of the number of plays have been performed.

* * * * *